United States Patent [19]

Gillespie et al.

[11] 4,181,598

[45] Jan. 1, 1980

[54] MANUFACTURE OF LUBE BASE STOCK OIL

[75] Inventors: Bernard M. Gillespie, Pitman; Michael S. Sarli, Haddonfield; Kenneth W. Smith, Woodbury, all of N.J.

[73] Assignee: Mobil Oil Corporation, New York, N.Y.

[21] Appl. No.: 862,460

[22] Filed: Dec. 20, 1977

Related U.S. Application Data

[63] Continuation-in-part of Ser. No. 817,309, Jul. 20, 1977, Pat. No. 4,137,148.

[51] Int. Cl.[2] ..... C10G 13/04; C10G 37/00

[52] U.S. Cl. ..... 208/58; 208/18; 208/86; 208/87

[58] Field of Search ..... 208/14, 18, 86, 87, 208/97, 58

[56] References Cited

U.S. PATENT DOCUMENTS

| | | | |
|---|---|---|---|
| 3,438,887 | 4/1969 | Morris et al. | 208/87 |
| 3,627,673 | 12/1971 | Sproule et al. | 208/211 |
| 3,658,689 | 4/1972 | Steinmetz et al. | 208/18 |
| 3,746,635 | 7/1973 | Woodle | 208/18 |
| 3,894,938 | 7/1975 | Gorring et al. | 208/97 |

*Primary Examiner*—Herbert Levine

*Attorney, Agent, or Firm*—Charles A. Huggett; Vincent J. Frilette

[57] ABSTRACT

Lube base stock oil of low pour point and excellent stability is produced from a waxy crude oil fraction by solvent refining, catalytic dewaxing over a zeolite catalyst in the nature of zeolite ZSM-5 and hydrotreating under specified conditions.

14 Claims, No Drawings

MANUFACTURE OF LUBE BASE STOCK OIL

CROSS REFERENCE TO RELATED APPLICATIONS

This application is a continuation-in-part of patent application Ser. No. 817,309 filed July 20, 1977 now U.S. Pat. No. 4,137,148.

BACKGROUND OF THE INVENTION

1. Field of the Invention

The invention is concerned with manufacture of high grade viscous oil products from crude petroleum fractions. It is particularly directed to the manufacture of high quality lube base stock oils from crude stocks of high wax content, commonly classified as "wax base" as compared with the "naphthenic base" crudes. The latter crudes are relatively lean in straight chain paraffins and yield viscous fractions which inherently possess low pour points.

2. Description of the Prior Art

High quality lube base stock oils are conventionally prepared by refining distillate fractions or the residuum prepared by vacuum distilling a suitable crude oil from which the lighter portion has been removed by distillation in an atmospheric tower. Thus, the charge to the vacuum tower is commonly referred to as a "long residuum," and the residuum from the vacuum tower is distinguished from the starting material by referring to it as the "short residuum."

The vacuum distillate fractions are upgraded by a sequence of unit operations, the first of which is solvent extraction with a solvent selective for aromatic hydrocarbons. This step serves to remove aromatic hydrocarbons of low viscosity index and provides a raffinate of improved viscosity index and quality. Various processes have been used in this extraction stage, and these employ solvents such as furfural, phenol, sulfur dioxide, and others. The short residuum, because it contains most of the asphaltenes of the crude oil, is conventionally treated to remove these asphalt-like constituents prior to solvent extraction to increase the viscosity index.

The raffinate from the solvent extraction step contains paraffins which adversely affect the pour point. Thus, the waxy raffinate, regardless of whether prepared from a distillate fraction or from the short residuum, must be dewaxed. Various dewaxing procedures have been used, and the art has gone in the direction of treatment with a solvent such as MEK/toluene mixtures to remove the wax and prepare a dewaxed raffinate. The dewaxed raffinate may then be finished by any of a number of sorption or catalytic processes to improve color and oxidation stability.

The quality of the lube base stock oil prepared by the sequence of operations outlined above depends on the particular crude chosen as well as the severity of treatment for each of the treatment steps. Additionally, the yield of high quality lube base stock oil also depends on these factors and, as a rule, the higher the quality sought, the less the yield. In general, naphthenic crudes are favored because less loss is encountered, particularly in the dewaxing step. In many cases, however, waxy crudes are more readily available, and it would be desirable to provide a process for preparing high quality lube base stock oils in good yields from such waxy crude oils.

In recent years techniques have become available for catalytic dewaxing of petroleum stocks. A process of that nature developed by British Petroleum is described in The Oil and Gas Journal dated Jan. 6, 1975, at pages 69–73. See also U.S. Pat. No. 3,668,113.

In U.S. Pat. No. Re. 28,398 is described a process for catalytic dewaxing with a catalyst comprising zeolite ZSM-5. Such process combined with catalytic hydrofinishing is described in U.S. Pat. No. 3,894,938.

In copending patent application Ser. No. 817,309 filed July 20, 1977 is described a process for preparing specialty oils of very low pour point and excellent stability from a waxy crude oil distillate fraction by solvent refining, catalytic dewaxing over a zeolite catalyst such as ZSM-5, and hydrotreating, under specified conditions. The entire contents of that patent application are incorporated herein by reference.

It is an object of this invention to provide a process for preparing a high quality lube base stock oil having a pour point not greater than +30° F. from a waxy crude oil. It is a further object of this invention to provide a process for preparing a high quality lube base stock oil having a pour point of about −25° F. to +30° F. from a waxy crude oil in high yield and with recovery of valuable paraffin wax. Other objects will be evident to those skilled in the art upon reading the entire contents of this specification including the claims thereof.

SUMMARY OF THE INVENTION

Known unit processes are applied to distillate or short residuum fractions of waxy crude in particular sequence and within limits to prepare lube base stock oils used, for example, in hydraulic fluids, motor oils, turbine oils, marine oils and gear lubricants. The first step after preparation of a distillate fraction of suitable boiling range is extraction with a solvent which is selective for aromatic hydrocarbons, e.g., furfural, phenol, or chlorex, to remove undesirable components of the fraction. With a short residuum fraction, it is required to propane deasphalt the residuum prior to solvent extraction. In some instances, such as with a cylinder stock, solvent extraction of the deasphalted short residuum may be omitted. The raffinate from solvent refining or propane deasphalting a short residuum is then catalytically dewaxed in admixture with hydrogen over a catalyst of an aluminosilicate zeolite having a silica to alumina ratio greater than 12 and a constraint index of 1 to 12. Dewaxed oil is hydrotreated to saturate olefins and to reduce product color. The total effluent from the dewaxer, including hydrogen, is cascaded to the hydrotreater and the reaction product thereafter distilled, i.e., topped by distillation, to separate low boiling products of dewaxing in order to meet flash and fire point separations. Conducting the unit processes at the conditions more fully specified hereinafter results in imparting high quality characteristics to the lube base stock oils and at the same time producing high yields of finished oils.

DESCRIPTION OF SPECIFIC EMBODIMENTS

The wax base crudes (sometimes called "paraffin base") from which the charge stock is derived by distillation constitute a well recognized class of crude petroleums. Many scales have been devised for classification of crude, some of which are described in Chapter VII Evaluation of Oil Stocks of "Petroleum Refinery Engineering," W. L. Nelson, McGraw-Hill, 1941. A convenient scale identified by Nelson at page 69 involves determination of the cloud point of the Bureau of Mines "Key Fraction No. 2" which boils between 527° and 572° F. at 40 mm. pressure. If the cloud point of this fraction is above 5° F., the crude is considered to be wax base.

In practice of the present invention, a propane deasphalted short residuum fraction or a fraction having an initial boiling point of at least about 450° F. and a final boiling point less than about 1100° F. is prepared by distillation of such wax base crude. That fraction is solvent refined by counter current extraction with at least an equal volume (100 vol.%) of a selective solvent such as furfural. It is preferred to use about 1.5 to about 3.0 volumes of solvent per volume of oil. The furfural raffinate is subjected to catalytic dewaxing by mixing with hydrogen and contacting at 500°–675° F. with a catalyst containing a hydrogenation metal and zeolite ZSM-5 or other aluminosilicate zeolite having a silica/alumina ratio above 12 and a constraint index of 1–12 and a liquid hourly space velocity (LHSV) of 0.1 to 2.0 volumes of charge oil per volume of catalyst per hour. The preferred space velocity is 0.5 to 1.0 LHSV. The effluent of catalytic dewaxing is then cascaded into a hydrotreater containing, as catalyst, a hydrogenation component on a non-acidic support, such as cobalt-molybdate or nickel-molybdate on alumina. The hydrotreater operates in the broad range of 425° to 600° F.; but the quality results are strongly affected by choice of temperature within this range. Most desirable results with short residuum fractions are obtained in the range 500° to 575° F.; for distillate fractions, in the range 425° to 500° F.; and space velocity like that of the catalytic dewaxing reactor. The reactions are carried out at hydrogen partial pressures of 150–1500 psia, at the reactor inlets, and preferably at 250–500 psia, with 500 to 5000 standard cubic feet of hydrogen per barrel of feed (SCF/B), preferably 1500 to 2500 SCF/B.

The catalytic dewaxing reaction produces olefins which would impair properties of the dewaxed oil product if retained. These are saturated by hydrogenation in the hydrotreater. The saturation reaction is evidenced by the temperature rise in the first portion of the hydrotreater, and confirmed by chemical analysis of the feed and hydrotreated product. By this means it is possible to prepare stable good quality lube base stock oils having pour points even below −65° F.

In some instances it may be desirable to partially dewax the charge stock, i.e., solvent-extracted raffinate, by conventional solvent dewaxing techniques, say to a pour point from 10° F. to about 50° F. The higher melting point waxes so removed are those of higher market value than the waxes removed in conventionally taking the product to a still lower pour point below 10° F.

The cracked (and hydrogenated) fragments from cracking wax molecules in the catalytic dewaxer will have adverse effects on flash and fire points of the dewaxed raffinate product and are therefore removed by distillation of the product to flash and fire point specifications.

The catalyst employed in the catalytic dewaxing reactor and the temperature in that reactor are important to success in obtaining good yields and very low pour point product. The hydrotreater catalyst may be any of the catalysts commercially available for that purpose but the temperature should be held within narrow limits for best results.

The solvent extraction technique is well understood in the art and needs no detailed review here. The severity of extraction is adjusted to composition of the charge stock to meet specifications for the particular lube base stock and the contemplated end-use; this severity will be determined in practice of this invention in accordance with well established practices.

The catalytic dewaxing step is conducted at temperatures of 500° to 675° F. At temperatures above about 675° F., bromine number of the product generally increases significantly and the oxidation stability decreases.

The dewaxing catalyst is a composite of hydrogenation metal, preferably a metal of Group VIII of the Periodic Table, associated with the acid form of a novel class of aluminosilicate zeolite having a silica/alumina ratio of at least about 12 and a constrained access to the intracrystalline free space, as more fully described hereinbelow.

An important characteristic of the crystal structure of this class of zeolites is that it provides constrained access to, and egress from the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e., they exhibit "hydrophobic" properties. It is believed that this hydrophobic character is advantageous in the present invention.

The type zeolites useful in this invention freely sorb normal hexane and have a pore dimension greater than about 5 Angstroms. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although, in some instances, excessive puckering or pore blockage may render these zeolites ineffective. Twelve-membered rings do not generally appear to offer sufficient constraint to produce the advantageous conversions, although puckered structures exist such as TMA offretite which is a known effective zeolite. Also, structures can be conceived, due to pore blockage or other cause, that may be operative.

Rather than attempt to judge from crystal structure whether or not a zeolite possesses the necessary constrained access, a simple determination of the "constraint index" may be made by passing continuously a mixture of an equal weight of normal hexane and 3-methylpentane over a small sample, approximately 1 gram or less, of catalyst at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromotography, to determine the fraction remaining unchanged for each of the two hydrocarbons.

The "constraint index" is calculated as follows:

$$\text{Constraint Index} = \frac{\log_{10}}{\log_{10}} \frac{\text{(fraction of n-hexane remaining)}}{\text{(fraction of 3-methylpentane remaining)}}$$

The constraint index approximates the ratio of the cracking rate constants for the two hydrocarbons. Zeolites suitable for the present invention are those having a constraint index in the approximate range of 1 to 12. Constraint Index (CI) values for some typical zeolites are:

| CAS | C.I. |
|---|---|
| ZSM-5 | 8.3 |
| ZSM-11 | 8.7 |
| ZSM-12 | 2 |
| ZSM-38 | 2 |
| ZSM-35 | 4.5 |
| TMA Offretite | 3.7 |
| Beta | 0.6 |
| ZSM-4 | 0.5 |
| H-Zeolon | 0.4 |
| REY | 0.4 |
| Amorphous Silica-Alumina | 0.6 |
| Erionite | 38 |

It is to be realized that the above constraint index values typically characterize the specified zeolites but that such are the cumulative result of several variables used in determination and calculation thereof. Thus, for a given zeolite depending on the temperature employed within the aforenoted range of 550° to 950° F., with accompanying conversion between 10% and 60%, the constraint index may vary within the indicated approximate range of 1 to 12. Likewise, other variables such as the crystal size of the zeolite, the presence of possible occluded contaminants and binders intimately combined with the zeolite may affect the constraint index. It will accordingly be understood by those skilled in the art that the constraint index, as utilized herein, while affording a highly useful means for characterizing the zeolites of interest is approximate, taking into consideration the manner of its determination, with probability, in some instances, of compounding variable extremes. However, in all instances, at a temperature within the above-specified range of 550° F. to 950° F., the constraint index will have a value for any given zeolite of interest herein within the approximate range of 1 to 12.

The class of zeolites defined herein is exemplified by ZSM-5, ZSM-11, ZSM-12, ZSM-35, ZSM-38, and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-35 is more particularly described in U.S. Pat. No. 4,016,245, the entire contents of which is incorporated herein by reference.

ZSM-38 is more particularly described in U.S. Pat. No. 4,046,859, the entire contents of which is incorporated herein by reference.

The specific zeolites described, when prepared in the presence of organic cations, are catalytically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does appear to favor the formation of this special type of zeolite. More generally, it is desirable to activate this type catalyst by base exchange with ammonium salts followed by calcination in air at about 1000° F. for from about 15 minutes to about 24 hours.

Natural zeolites may sometimes by converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminosilicates are ZSM-5, ZSM-11, ZSM-12, ZSM-38 and ZSM-35, with ZSM-5 particularly preferred.

In a preferred aspect of this invention, the zeolites hereof are selected as those having a crystal framework density, in the dry hydrogen form, of not substantially below about 1.6 grams per cubic centimeter. It has been found that zeolites which satisfy all three of these criteria are most desired. Therefore, the preferred zeolites of this invention are those having a constraint index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pycnometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, is important as the locus of catalytic activity.

Crystal framework densities of some typical zeolites are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .41 | 1.55 |
| Levynite | .41 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable ions of Groups IB to VIII of the Periodic Table, including, by way of example, nickel, cooper, zinc, palladium, calcium or rare earth metals.

In practicing the desired conversion process, it may be desirable to incorporate the above described crystalline aluminosilicate zeolite in another material resistant to the temperature and other conditions employed in the process. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral consistuent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix may vary widely with the zeolite content ranging from between about 1 to about 99 percent by weight and more usually in the range of about 5 to about 80 percent by weight of the composite.

In the process of this invention, the total effluent of the catalytic dewaxing step, including the hydrogen, is cascaded into a hydrotreating reactor of the type now generally employed for finishing of lubricating oil stocks. In this "cascade" mode of operation, the hydrotreater is sized to handle the total dewaxer effluent. Although some modification of the cascade operation is contemplated, such as interstage recovery of gasoline boiling range by-product, it is to be understood that such modification contemplates no substantial interruption or substantial delay in passing the dewaxed raffinate to the hydrotreater. Thus, "cascading," as used herein, means passing the dewaxed raffinate plus hydrogen to hydrotreating without storage of the dewaxer effluent.

Any of the known hydrotreating catalysts consisting of a hydrogenation component on a non-acidic support may be employed in the hydrotreating step. Such catalysts include, for example, cobalt-molybdate or nickel-molybdate on an alumina support. Here again, temperature control is required for production of high quality product, the hydrotreater being operated at 425° to 500° F. with distillate fractions and 500° to 575° F. for residuum fractions.

The effluent of the hydrotreater is topped by distillation, i.e., the most volatile components are removed, to meet flash and fire point specifications.

Whereas this invention has been described in terms of current technology, it is to be understood of course that lube oil refining technology continues to evolve in that new solvents for solvent-refining, modifications of dewaxing and fractionation procedures and other innovations continue to be proposed. Therefore, it is to be understood that this invention is not limited to the specific description contained herein, but is adaptable to innovations in the unit processes themselves. In this spirit, then, the following examples are given as illustrative of this invention and are not to be construed as limiting thereon except as defined by the claims. In the examples, all parts given are by weight unless specified otherwise.

EXAMPLE 1

This example illustrates the manufacture, without wax recovery, of premium bright stock from short residuum of Arabian Light crude.

The short residuum, commercially prepared from Arabian Light crude, was propane deasphalted in a commercial unit in such a way as to yield a 1.0 to 1.5% wt. Conradson Carbon Residue PD raffinate. Said PD raffinate was then commercially furfural extracted to give a product which when dewaxed to 20° F. pour point had a Viscosity Index of 95.

Two catalytic reactors were assembled so that the total effluent from the first reactor was passed directly to the inlet of the second reactor. The first reactor was charged with nickel-containing HZSM-5 catalyst for catalytic dewaxing, and the second reactor with a commercial cobalt-moly on alumina hydrotreating catalyst (Harshaw HT-400 catalyst, containing 2.8 wt.% CoO and 9.4 wt.% $MoO_3$).

The above-described commercial bright stock raffinate was mixed with hydrogen and passed through the tandem reactors above described to produce a dewaxed hydrotreated effluent. Both reactors were run at 1.0 LHSV based on raffinate charge. Reactor pressure was 400 psig $H_2$ with 2500 SCF/B hydrogen circulation (100% hydrogen once-through). An initial temperature requirement of 550° F. was needed in the first reactor to meet pour point specification while the second reactor was held constant at 550° F. The temperature in the catalytic dewaxing reactor was increased 9° to 10° F. per day to maintain the pour point of the dewaxed oil at about 20° F. The end of cycle temperature for the catalytic dewaxer unit was 675° F. The effluent from the catalytic reactors was distilled (topped) to a cut point of 800° F. to meet flash point specifications. The bright stock raffinate charge and product properties are summarized in Table I.

TABLE I

PROPERTIES OF HYDRODEWAXED/HYDROTREATED PREMIUM BRIGHT STOCK FURFURAL RAFFINATE

| Stream | Charge | Product |
|---|---|---|
| Hydrodewaxing Temperature, °F. | — | 550–675 |
| Yield on Raffinate, % volume | 100.0 | 87.8 |
| Product Properties | | |
| Gravity, API | 25.4 | 24.4 |
| Gravity, Specific at 60° F. | 0.9018 | 0.9076 |
| Pour point, °F. | 125 | 15 |
| Flash Point, °F. (C.O.C.) | — | 550 |
| KV at 40° Centistrokes | — | 475 |
| KV at 100° C. Centistrokes | — | 30.7 |
| KV at 100° F. Centistrokes | — | 550 |
| KV at 210° F. Centistrokes | 29.7 | 31.8 |
| SUS at 100° F. Seconds | — | 2549 |
| SUS at 210° F. Seconds | 141 | 150 |
| Viscosity Index | — | 94 |
| Neutralization No. Mg. KOH/gm | — | 0.09 |
| Carbon Residue, % Wt (RCR) | 0.55 | 0.56 |
| Hydrogen, % Wt. | 13.29 | 13.10 |
| Sulfur, % Wt. | 1.16 | 1.06 |
| Nitrogen, ppm | 180 | 180 |
| Refractive Index at 20° C. | — | 1.49815 |
| Refractive Index at 70° C. | 1.47701 | 1.48177 |
| Aniline Point, °F. | 251.5 | 242.6 |
| Furfural, ppm | — | <1 |
| Bromine Number | — | 0.5 |
| Distillation, °F. | | D1160-1 |
| 5, % vol | | 859 |
| 10, % vol | | 922 |
| 30, % vol | | 1005 |
| 50, % vol | | 1046 |
| 70, % vol | | 1091 |

The yield, 87.8% shown in Table I, is about 13 volume % higher than obtained with conventional commercial solvent dewaxing to comparable pour point of the same bright stock raffinate. The catalytically dewaxed and hydrotreated bright stock product passed the required oxidation specification tests. At the end of the above-described run the dewaxing catalyst was reactivated with pure hydrogen at 900° F. for 24 hours with full recovery of initial activity.

EXAMPLE 2

This example is similar to Example 1 except that the bright stock raffinate of Example 1 was first solvent dewaxed to +45° F. pour point and then catalytically dewaxed and hydrotreated. Thus, all high grade deoiled wax is recovered in this present example.

The bright stock raffinate described in Example 1 was batch solvent dewaxed in the laboratory at 30° F. filter temperature using 3.5 to 1 solvent to oil and two 1 to 1 washes. The solvent was a 50/50 mix of methyl ethyl ketone and toluene. The partially dewaxed raffinate had a pour point of +45° F., simulating addition of foots oil by-product with the solvent dewaxed oil stream prior to further processing. A 7.3% volume yield of wax was obtained which had a satisfactory melting point of 181.5° F., oil content of 0.28% wt. and API gravity of 33.7.

The partially dewaxed raffinate was then treated catalytically as in Example 1 except that the start of run temperature of the catalytic dewaxer was 530° F. instead of 550° F., and then topped.

Table II summarizes the properties of the catalytically dewaxed, hydrotreated bright stock after 550° F. hydrotreating and topping. The dewaxed oil yield at 20° F. pour based on charge to the catalytic dewaxer/hydrotreater was 94.5% by volume.

TABLE II

Properties from Combination Solvent Dewaxing/Hydrodewaxing/Hydrotreating Premium Bright Stock Furfural Raffinate

| | Solvent Dewaxed Oil and Foots Oil | Hydrodewaxed Lube Product |
|---|---|---|
| Yield on Raffinate, % Volume | 92.7 | 87.6 |
| Properties | | |
| Gravity, °API | 24.7 | 24.4 |
| Gravity,Specific at 60° F. | 0.9059 | 0.9076 |
| Pour Point, °F. | 45 | 15 |
| Flash Point, °F. (C.O.C.) | — | 580 |
| KV at 40° C. Centistokes | 389 | 482 |
| KV at 100° C. Centistokes | 29.8 | 31.6 |
| KV at 100° F. Centistokes | 446 | 558 |
| KV at 210° F. Centistokes | 30.8 | 32.7 |
| SUS at 100° F. Seconds | 2066 | 2585 |
| SUS at 210° F. Seconds | 146 | 155 |
| Viscosity Index | 107 | 96 |
| Color, ASTM | 5¾ | 2½ |
| Neutralization No. Mg. KOH/gm | <0.05 | 0.05 |
| Carbon Residue, % wt. (RCR) | 0.52 | 0.56 |
| Hydrogen, % wt. | 13.06 | 13.01 |
| Sulfur, % wt. | 1.34 | 1.00 |
| Nitrogen, ppm | 110 | 62 |
| Refractive Index at 20° C. | 1.49820 | 1.49887 |
| Refractive Index at 70° C. | 1.48095 | 1.48167 |
| Aniline Point, °F. | 245.4 | 243.5 |
| Furfural, ppm | — | <1 |
| Bromine Number | — | 0.3 |
| Oil Content, % wt. | — | — |
| Melting Point, °F. | — | — |
| Distillation, Type | D-1160 | D-1160 |
| IBP, °F. | — | — |
| 5 | 919 | 899 |
| 10 | 950 | 931 |
| 30 | 1002 | 992 |
| 50 | — | — |
| 70 | — | — |
| 90 | — | — |
| 95 | — | — |

Compared with conventional commercial solvent dewaxed oil of +20° F. pour point prepared from the identical bright stock raffinate, a 12% increase in volume % yield is realized with the process of this invention with no change in viscosity index and no loss in deoiled wax yield.

EXAMPLE 3

This example illustrates the preparation of a heavy automotive neutral oil by the process of this invention.

A commercially prepared nominal 450 SUS (Saybolt Universal Seconds viscosity) at 100° F. distillate from Arabian Light crude was furfural extracted in the laboratory at 210° F. and 160% volume furfural. The furfural raffinate was catalytically dewaxed/hydrotreated as described in Example 1 but with the hydrotreater operated at 475° F. with the results shown:

| Yield, % Raffinate | |
|---|---|
| $C_3$'s and lighter, % wt. | 3.3 |
| $C_4$'s, % vol. | 6.0 |
| $C_5$–330° F., % vol. | 10.9 |
| 330–650 650° F., % vol. | 1.5 |
| Dewaxed Oil, % vol. | 81.9 |
| Catalytically Dewaxed/Hydrotreated Oil Properties | |
| Bromine No. | 0.9 |
| Pour Point, °F. | +20 |
| SUS at 100° F. | 570 |
| Viscosity Index | 92 |
| Cat 1-H, 240 hrs. (Formulated) | |
| WTD | 53 |
| TGF, % | 8 |
| Assessment | Pass |

What is claimed is:

1. A process for preparing a high quality lube base stock oil having a pour point of about −25° to +30° F. from waxy crude oil, which comprises:

extracting a distillate fraction that boils within the range of 450° to 1100° F. or a deasphalted short residuum fraction of said waxy crude with a solvent selective for aromatic hydrocarbons to yield a raffinate from which undesirable compounds have been removed;

mixing the raffinate with hydrogen and contacting the mixture at a temperature of 500° to 675° F. with a dewaxing catalyst comprising an aluminosilicate zeolite having a silica/alumina ratio of at least about 12 and a constraint index of about 1 to about 12, thereby converting wax contained in the raffinate to lower boiling hydrocarbons;

cascading the dewaxed raffinate to a hydrotreating zone wherein the dewaxed raffinate is contacted in the presence of hydrogen at a temperature of 425° to 600° F. with a hydrotreating catalyst comprising a hydrogenation component on a non-acidic support; and topping the dewaxed, hydrotreated raffinate to remove therefrom components of a low molecular weight.

2. The process described in claim 1 wherein said raffinate is prepared by extraction of said distillate fraction, the total effluent of said catalytic dewaxing step is cascaded to said hydrotreating zone, and contact with said hydrotreating catalyst is at a temperature of 425° to 500° F.

3. The process described in claim 1 wherein said raffinate is prepared by extraction of said deasphalted short residuum fraction, the total effluent of said catalytic dewaxing step is cascaded to said hydrotreating zone, and contact with said hydrotreating catalyst is at a temperature of 500° to 575° F.

4. The process described in claim 1 wherein said dewaxing catalyst comprises an aluminosilicate zeolite having a crystal framework density of not less than 1.6 grams per cubic centimeter.

5. The process described in claim 1 wherein said hydrodewaxing catalyst comprises ZSM-5 and a hydrogenation metal.

6. The process described in claim 2 wherein said hydrodewaxing catalyst comprises ZSM-5 and a hydrogenation metal.

7. The process described in claim 3 wherein said hydrodewaxing catalyst comprises ZSM-5 and a hydrogenation metal.

8. The process described in claim 2 wherein said raffinate is partially dewaxed by solvent dewaxing before said contact with hydrodewaxing catalyst.

9. The process described in claim 3 wherein said raffinate is partially dewaxed by solvent dewaxing before said contact with hydrodewaxing catalyst.

10. The process described in claim 2 wherein said hydrotreating catalyst is cobalt molybdate on alumina or nickel molybdate on alumina.

11. The process described in claim 3 wherein said hydrotreating catalyst is cobalt molybdate on alumina or nickel molybdate on alumina.

12. The process described in claim 5 wherein said hydrogenation metal is nickel.

13. The process described in claim 6 wherein said hydrogenation metal is nickel.

14. The process described in claim 7 wherein said hydrogenation metal is nickel.

* * * * *